United States Patent [19]

Battaglia

[11] Patent Number: 5,056,272

[45] Date of Patent: Oct. 15, 1991

[54] METHOD AND APPARATUS FOR REDUCING THICKNESS OF STONE SLABS

[76] Inventor: Gino C. Battaglia, 25022 S. Vermont Ave., Harbor City, Calif. 90710

[21] Appl. No.: 552,541

[22] Filed: Jul. 16, 1990

[51] Int. Cl.[5] ..... B24B 7/06

[52] U.S. Cl. ..... 51/283 R; 51/326; 51/76 R; 125/14; 125/13.01

[58] Field of Search ..... 125/13.01, 14; 51/74 R, 51/76 R, 283 R, 326

[56] References Cited

U.S. PATENT DOCUMENTS

| | | | |
|---|---|---|---|
| 164,486 | 6/1875 | Rochow | 125/13.01 |
| 1,710,238 | 4/1929 | Owen | 51/74 |
| 2,850,848 | 9/1958 | Boltz | 51/74 |
| 3,545,140 | 12/1970 | Jones | 125/14 |
| 3,547,096 | 12/1970 | Ronzani | 125/13.01 |
| 4,131,103 | 12/1978 | Ishikawa | 125/13.01 |
| 4,660,539 | 4/1987 | Battaglia | 125/10 |

FOREIGN PATENT DOCUMENTS

| | | | |
|---|---|---|---|
| 0561469 | 4/1957 | Italy | 51/76 R |
| 0515116 | 9/1957 | Italy | 125/13.01 |

*Primary Examiner*—Robert A. Rose
*Attorney, Agent, or Firm*—Charles H. Thomas

[57] ABSTRACT

A stone slab is processed to reduce its thickness far more quickly and with much less difficulty according to an improved method and using a new machine. The machine includes a pair of motor driven sets of disk-shaped saw blades. Each set of saw blades is mounted on a separate, parallel axle. The saw blades are all of a uniform diameter. The saw blades in each set are separated by spacing rings. The sets of saw blades are mounted to reside in parallel planes, and the blades in each set are offset from coplanar alignment with the blades in the other set. A slab of stone to be reduced in thickness is advanced by a conveyor belt beneath the rotating sets of blades along a path parallel to the blades. The blades in the first set cut a number of parallel channels into the upwardly facing surface of the slab leaving ridges corresponding to the gaps between the saw blades in the first set. These ridges are cut away by the blades in the second set of saw blades as the saw advances past them, thereby reducing the thickness of the slab and leaving the slab with a flat upper surface and with a uniform thickness throughout.

16 Claims, 3 Drawing Sheets

METHOD AND APPARATUS FOR REDUCING THICKNESS OF STONE SLABS

BACKGROUND OF THE INVENTION

1. Field of the Invention

The present invention relates to a method and a machine for reducing the thickness of a stone slab to a desired dimension.

2. Description of the Prior Art

Slabs of stone, such as marble and granite, are machined and polished for use as table tops, pedestals, sculpture bases and for other decorative and structural purposes. To render a stone slab suitable for such an application it is often necessary to work a stone slab by reducing its thickness so as to create a smooth, uniform expansive surface, and then polishing that surface. The surface thus exhibits a clean, attractive sheen.

Some slabs used for decorative and structural articles of the type described have heretofore been reduced in thickness by grinding so as to achieve a uniform slab thickness and a smooth surface area. In such a procedure grinding wheels or grinding rollers having grinding surfaces formed of an abrasive, such as carborundum, are mounted for rotation above a horizontal bed across which the stone slab to be finished is passed. In one such prior art system a plurality of grinding wheels are mounted above the supporting bed for rotation about separate vertical axes. The circular grinding surfaces of the wheels are faced with carborundum or some other abrasive material. These grinding surfaces bear downwardly upon the slab to be finished. The several grinding wheels employed are arranged in a staggered pattern so that each grinding wheel will grind a swath of material from the stone slab as the slab passes in a linear path therebeneath Collectively the grinding wheels thereby cover the entire surface of the slab.

Conventional grinding machines and grinding processes of the type described are extremely time consuming. The time required to grind material from the face of a stone slab increases with the depth of material to be ground away. These prior grinding systems are also limited in the depth of stone which can be ground away. For example, such conventional systems are limited to grinding away about one-quarter of an inch of thickness of a four foot by eight foot granite slab, which is a typical size in the industry. Reduction of the thickness of such a slab by one-quarter of an inch, using a conventional system and according to a conventional method, requires approximately four or five hours. During this time the machine must be constantly attended. Thus, the number of stone slabs which can be reduced in thickness during a normal work shift is quite limited, thereby contributing substantially to the cost of finishing stone slabs in this manner.

SUMMARY OF THE INVENTION

In one broad aspect the present invention may be considered to be a machine for reducing the thickness of a stone slab to a desired dimension. The machine is comprised of first and second sets of saw disks which are respectively mounted on first and second common axles, a flat supporting bed separated from each of the saw disks by a uniform distance of separation equal to the desired dimension, and means for driving the first and second sets of saw disks in rotation.

The saw disks in the first set all have a common diameter and are mounted coaxially in mutual parallel planes of alignment on the first common axle to define gaps of axial separation from each other. Likewise, the saw disks in the second set have a common diameter and are mounted coaxially in mutually parallel planes of alignment which are parallel to the planes of alignment of the saw disks in the first set. The saw disks of the second set are mounted on the second common axle that is oriented parallel to the first common axle. The saw disks in the second set also define gaps of axial separation from each other. Moreover, the saw disks in the second set are offset in a direction perpendicular to the planes of saw disk alignment from the saw disks of the first set so as to reside in coplanar relationship with the gaps of axial separation between the saw blades of the first set.

In the machine of the invention the saw blades in the two sets are not coplanar but are offset from each other so as to reside in different but mutually parallel planes. As the stone slab to be machined is passed across the flat supporting bed, the saw blades in the first set each cut a channel into the stone slab leaving a thickness of the stone therebeneath equal to the final desired dimension of the slab. These channels are parallel to each other and are separated from each other by intervening ridges. The ridges correspond in width to the gaps of axial separation of the saw blades in the first set. As the stone slab is advanced, these ridges are cut away by the saw disks in the second set. The saw blades in the second set leave the same thickness of stone therebeneath as the blades in the first set, so that the stone slab is reduced to a uniform thickness throughout.

The machine of the invention preferably is comprised of a means for propelling a stone slab on the supporting bed in a direction parallel to the plane of alignment of the saw disks. In this connection the flat supporting bed may be comprised of an endless conveyor belt disposed horizontally directly beneath the first and second set of saw disks, with the conveyor belt forming a loop over a pair of horizontally oriented drums aligned along axes perpendicular to the planes of orientation of the saw disks. The function of propelling the stone slab can be performed by a motor in one or both of the drums.

The machine of the invention is preferably also comprised of means for adjusting the distance of separation between the saw disks and the supporting bed. This function may be performed by a carriage supporting the saw disk axles in a horizontal disposition above the upper surface of the conveyor belt, and also a means for varying the elevation of the carriage.

While stone slabs are preferably reduced in thickness by a depth of a maximum of about one-half of an inch, there is no limit to the depth of stone which can be cut away according to the present invention, other than the limit imposed by the diameter of the saw disks. That is, saw disks of a larger diameter are capable of cutting away stone to a greater depth than saw disks of a smaller diameter, since the cut must necessarily be less than the saw disk radius. Since the invention involves cutting the stone rather than grinding it, there is no significant difference in the time required to reduce a stone slab to a desired dimension whether a small or great depth of stone is cut away.

Preferably annular spacer rings are disposed about the axles and between adjacent saw disks thereon. The outer diameters of the annular rings are preferably about one half the diameter of the saw blades between which they are disposed. These spacer rings ensure that the widths of the gaps between adjacent saw disks are properly defined and are uniform. Also, the annular rings aid in laterally stabilizing the saw disks to ensure that each saw disk stays within a specific plane of alignment.

The saw disks in each set of saw disks are preferably keyed to rotate with the common axle upon which they are mounted. In this way the saw disks in each set of saw disks rotate in tandem with each other. Also, while each of the saw disks in each set must be of the same diameter, the saw disks in both sets preferably have the same diameter as well.

In another broad aspect the invention may be considered to be a method of reducing the thickness of a stone slab using a plurality of mutually parallel saw disks divided into two sets for rotation about separate, parallel axes, wherein the blades in each set are separated from each other by gaps of separation aligned with the disks in the other set. A flat supporting bed extending parallel to the axes and defining a uniform distance equal to a desired slab thickness between the saw blades and the supporting bed is also used.

The method of the invention is comprised of the steps of rotating sets of saw disks about their respective axes and passing a stone slab of initial thickness greater than the uniform distance between the saw disks and the supporting bed in a direction of advancement parallel to both the saw disks and the supporting bed. This defines a first set of channels in the stone slab that are separated from each other by intervening ridges left by the gaps of separation between the saw disks in the first set. The stone slab is then passed in the same direction of movement past the saw disks in the second set to remove the intervening ridges from the slab and reduce the slab to a uniform thickness equal to the desired slab thickness. By using two offset sets of saw disks according to the invention the desired slab thickness can be achieved by passing the stone slab between the supporting bed and the first and second sets of blades only a single time.

The invention may be described with greater clarity and particularity with reference to the accompanying drawings.

DESCRIPTION OF THE EMBODIMENT AND IMPLEMENTATION OF THE METHOD

Figure 1:
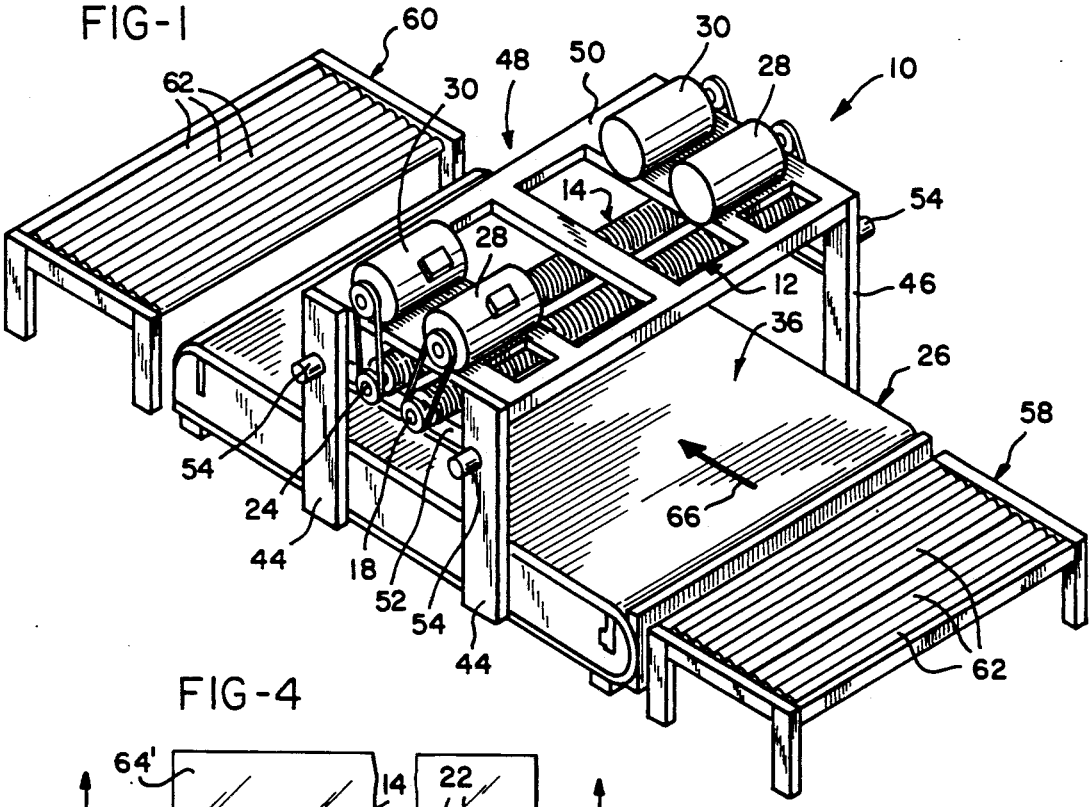
FIG. 1 is a perspective view of a machine for reducing the thickness of a stone slab to a uniform desired dimension according to the invention.
Figure 2:
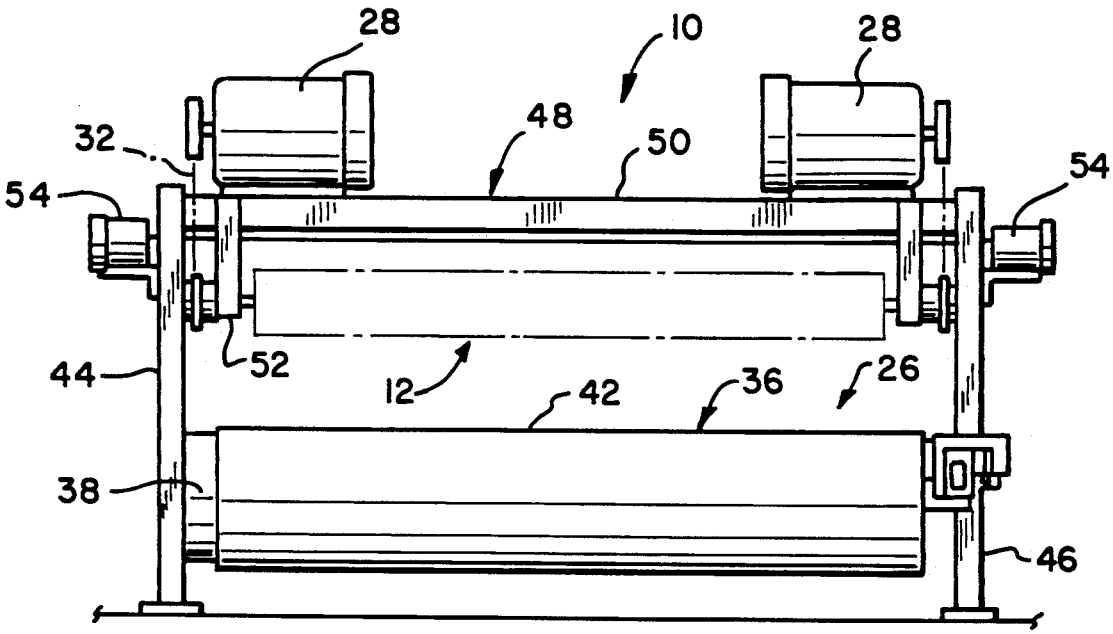
FIG. 2 is an end elevational view of the machine of FIG. 1.
Figure 3:
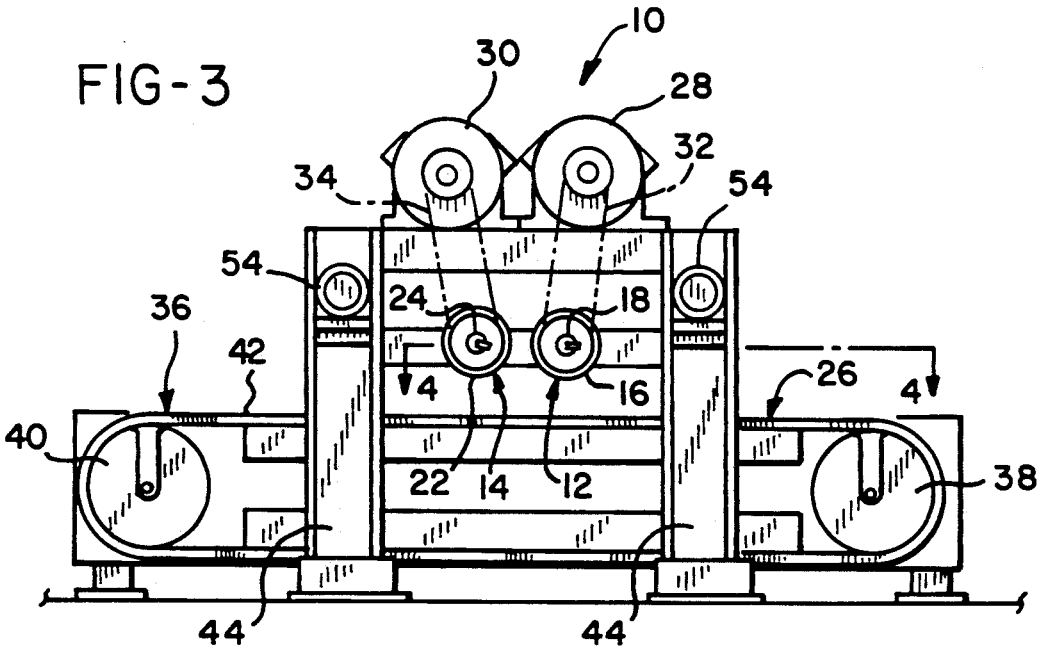
FIG. 3 is a side elevational view of the machine of FIG. 1.

FIGS. 1 through 3 show a machine 10 for reducing the thickness of a stone slab to a uniform desired dimension. The machine 10 is comprised of a first set of saw blades 12 and a second set of saw blades 14. The individual saw blades 16 in the first set of saw blades 12 are formed as mutually parallel planer disks, each having a width giving it a finite thickness, typically about three-eighths of an inch at its peripheral cutting edge. The peripheral edges of the saw disks 16 are tipped with industrial cutting diamonds. The saw disks 16 are of the type employed in the industry for the purpose of cutting stone slabs into different widths or lengths. The disks 16 all have an outer diameter of eight inches and are mounted on and locked to a first common axle 18 by means of a key. Annular spacer rings 20 which are four inches in outer diameter are disposed on the axle 18 between the adjacent saw disks 16 thereon to define gaps of separation between the saw disks 16. The saw disks 16 with the annular spacing rings 20 therebetween are clamped together between a pair of clamping nuts 21 that are threadably engaged on the axle 18.

Similarly, the second set of saw blades 14 is formed with mutually parallel planar saw disks 22 of a size and construction identical to the saw disks 16. The saw disks 22 are likewise mounted on and locked to a second common axle 24. Additional annular spacer rings 20 are disposed on the axle 24 between adjacent saw blades 22 to define gaps of separation between the saw blades 22. The saw blades 22 and spacer rings 20 are clamped in position on the axle 24 by clamping nuts 25 that are threadably engaged on threaded sections of the axle 24.

Figure 4:
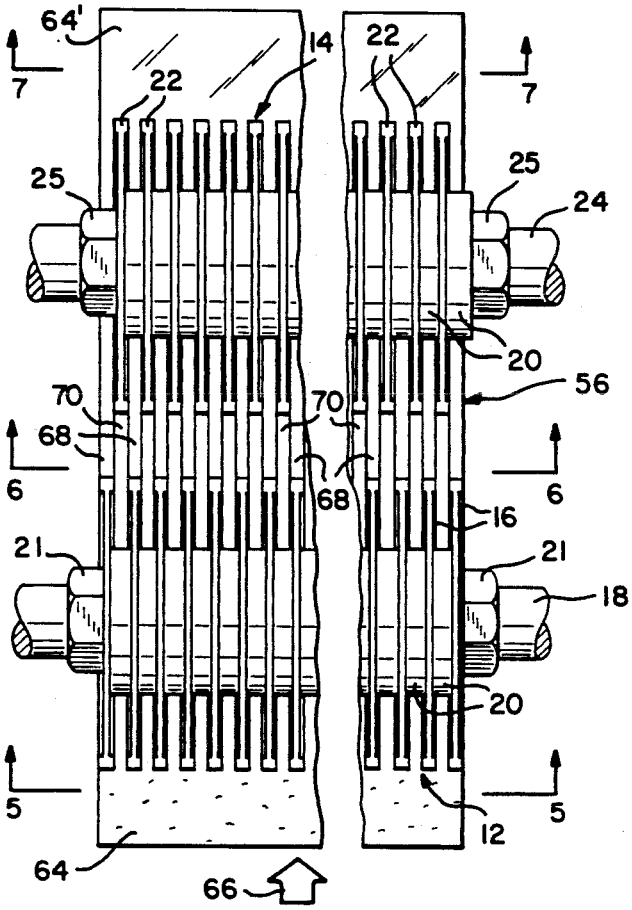
FIG. 4 is a top plan detail taken along the lines 4—4 of FIG. 3.

As illustrated in FIG. 4, the saw blades 22 in the second saw blades set 14 are aligned in coplanar relationship with the gaps of separation between the saw blades 16 in the first saw blade set 12. The saw blades 22 in the second saw blade set 14 are at least as thick as the gaps of separation between the saw blades 16 with which they are aligned. The saw blades 22 reside in planes parallel to but offset from the planes of alignment of the saw blades 16. This offset is typically about three-eighths of an inch.

The machine 10 is further comprised of a flat supporting bed 26 that extends parallel to the axles 18 and 24. The flat supporting bed 26 is equidistant from each of the saw blades 16 and 18, as illustrated in FIG. 3. The distance between the supporting bed 26 and the saw blades 16 and 22 thereabove defines the uniform desired dimension of the finished stone slab.

The machine 10 is also comprised of a means for driving the saw blades 16 and 22 in rotation. This means is provided in the form of electric motors 28 and 30 and belt drives 32 and 34. The belt drives 32 and 34 are formed of conventional V-belts and pulleys. The belt drives 32 are coupled to the axle 18 so that the motors 28 turn the axle 16 in a clockwise direction, as viewed in FIG. 3. Similarly, the belt drives 34 are coupled to the axle 24 so that motors 30 turn the axle 24 in a clockwise direction, as viewed in FIG. 3.

The supporting bed 26 is formed of an endless conveyor belt 36 which may be six feet wide and which extends in a loop about a pair of cylindrical, motorized drums 38 and 40 located about ten feet apart at opposite ends of the machine 10. The drums 38 and 40 drive the conveyor belt 36 in a counter-clockwise loop as viewed in FIG. 3. As the endless conveyor belt 36 travels, the upwardly facing surface 42 thereof is disposed horizontally and passes directly beneath the first set 12 and the second set 14 of saw blades 16 and 22, respectively. The vertical distance between the upwardly facing surface 42 of the conveyor belt 36 and the saw blades 16 and 22 is the dimension of the stone slab that results from the cutting operation of the invention, and it is this distance which must be calibrated to the desired dimension.

The machine 10 is further comprised of a pair of upright supporting stanchions 44 on one side of the supporting bed 26 and a pair of similar upright supporting stanchions 46 on the opposite side of the supporting bed 26. A carriage 48 is provided and has an upper open framework platform 50 and a lower axle supporting framework 52 secured thereto. The upper platform 50 supports the driving motors 28 and 30, while the lower framework 52 supports the horizontally disposed axles 18 and 24 above the horizontally disposed flat supporting bed 26.

The carriage 48 is mounted in a horizontal disposition on the stanchions 44 and 46 above the flat supporting bed 26 and is vertically movable relative thereto. Stepper motors 54, operated in tandem, lift or lower the platform 48 in fine increments under the control of a machine operator. The stepper motors 54 form a height adjustment means for moving the carriage 48 in a vertical direction along the stanchions 44 and 46. The stepper motors 54 provide means for adjusting the elevation of the carriage 48 above the supporting bed 26. The stepper motors 54 thereby allow the machine operator to precisely calibrate the separation of the saw blades 16 and 22 from the flat upper surface 42 of the conveyor belt 36, and thereby closely calibrate and gauge the thickness of the stone slab as it emanates from the machine 10. The stepper motors 54 lift and lower the platform 48 through a worm drive system, or through any other positioning mechanism capable of fine positioning adjustable control.

To reduce the thickness of a stone slab according to the method of the invention, the stepper motors 54 are operated to raise or lower the platform 48 to adjust the distance of the saw blade disks 16 and 22 from the supporting bed 26 so as to define the desired slab thickness. For example, the stepper motors 54 may be operated under operator control to raise or lower the platform 48 so that the vertical distance of separation between both the saw blades 16 and the saw blades 22 from the flat upper surface 42 of the conveyor belt 36 is equal to one-half of one inch.

Once the dimension of one-half of an inch has been established as the desired slab thickness, a flat stone slab, such as the stone slab 56, depicted in FIG. 4, must be brought into position adjacent to the flat supporting bed 26. A supporting roller table 58 may be provided at the entrance end of the machine 10, while another supporting roller table 60 may be provided at the discharge end thereof. The tables 58 and 60 are equipped with a plurality of rollers 62 that are all disposed in a horizontal plane to rotate about axes parallel to the axes of rotation of the motorized drums 38 and 40. The rollers 62 facilitate advancement of the slab 56 through the machine 10. Once the stone slab 56 emerges from the machine 10 onto the receiving roller table 60, it is normally passed directly into an automated stone polishing machine.

Figure 5:
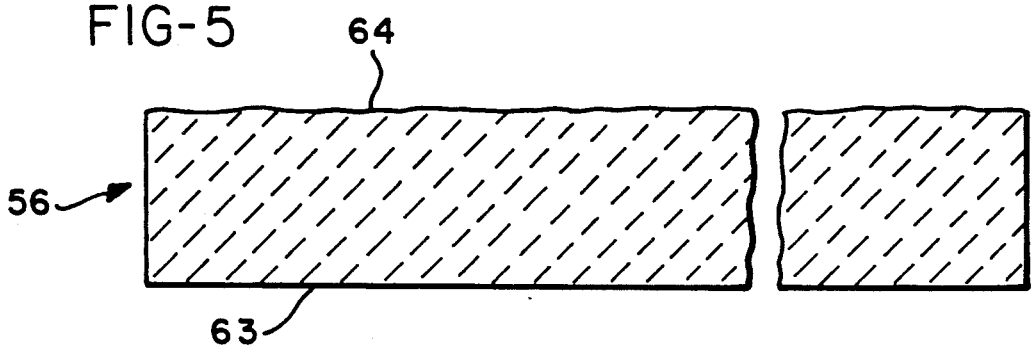
FIG. 5 is a transverse elevational section taken along the lines 5—5 of FIG. 4.

The stone slab 56 may be a slab of granite four feet in width, eight feet in length and initially three-quarters of an inch in thickness. The initial cross section of the slab 56 is illustrated in FIG. 5. Typically the upper surface 64 of the slab 56, although generally flat, is still slightly rough as indicated. The undersurface 63 of the slab 56 rests atop the upwardly facing surface 42 of the conveyor belt 36.

Once the stone slab 56 has been brought into position atop the roller table 58, it is manually pushed onto the conveyor belt 36 at the entrance of the machine 10. When the leading edge of the granite slab 56 resides atop the upper surface 42 of the conveyor belt 36, the motors within the motorized drums 38 and 40 serve as a means for forcing the stone slab 56 between the supporting bed 26 and the saw blades 16 and 22. The stone slab 56 is forced in a direction 66 parallel to both the saw blades 16 and 22 and to the supporting bed 26, as illustrated in FIGS. 1 and 4.

Figure 6:
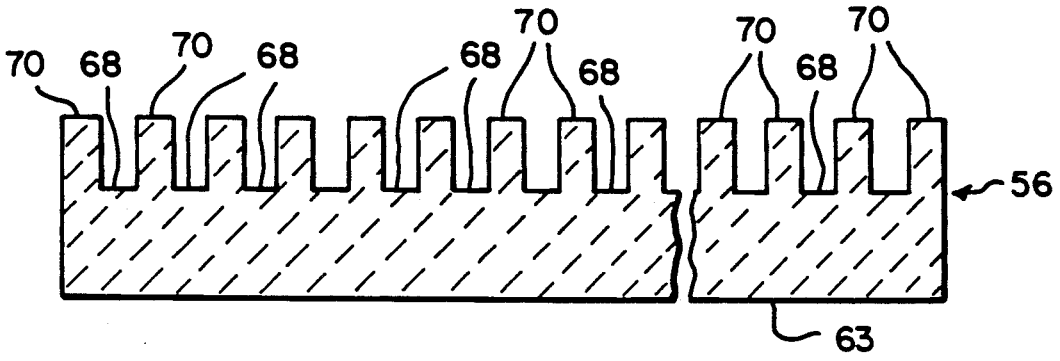
FIG. 6 is a transverse elevational section taken along the lines 6—6 of FIG. 4.

As the stone slab 56 approaches the blade disks 16 in the first saw blade set 12, the blade disks 16 bite into the upper surface 64 of the stone slab 56. As the stone slab 56 advances in the direction indicated by the directional arrow 66, the parallel saw blade disks 16 cut away the stone and define parallel grooves or channels 68 in the upper surface 64 of the stone slab 56. With the carriage 48 adjusted relative to the supporting bed 26 as previously described, the channels 68 are one-quarter of an inch in depth. The channels 68 are separated from each other by intervening ridges 70 of the original material of the upper surface 64 of the stone slab 56 that is left uncut at locations corresponding to the gaps of separation between the adjacent saw blade disks 16. The portion of the stone slab 56 between the saw disk sets 12 and 14 has a cross section as illustrated in FIG. 6.

As the stone slab 56 approaches the saw blade disks 22 in the second saw blade set 14, the saw blade disks 22 begin to bite into the ridges 70. The widths of the peripheral cutting edges of the saw blade disks 22 are at least as great as the gaps of separation between the peripheral cutting edges of the saw blades 16, so that as the stone slab 56 passes beneath the axle 24, the ridges 70 are cut entirely away leaving the entire upper surface 64' of the stone slab 56 smooth and uniform. The cross section of the stone slab 56 as it is discharged from the machine 10 and passes onto the receiving roller table 60 is illustrated in FIG. 6. The reduced thickness of the stone slab 56 between its underside 63 and its finished upwardly facing surface 64' is, in the example described, one-half of one inch.

Figure 7:
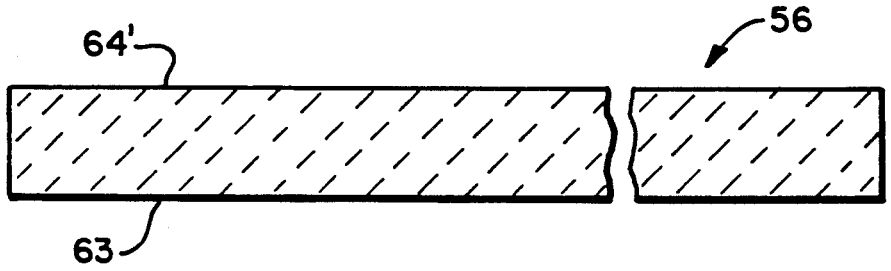
FIG. 7 is a transverse elevational section taken along the lines 7—7 of FIG. 4.

Contrary to the prior art grinding systems, the entire expanse of the stone slab 56 can be reduced in thickness from the profile of FIG. 5, in which the nominal thickness is three-quarters of an inch, to the profile of FIG. 7, in which the thickness is uniform and has a dimension of one-half of an inch in just ten to fifteen minutes. This contrasts dramatically with the time of at least four or five hours that would be required to achieve the same results using conventional machines and techniques. Moreover, significantly more than one-quarter of an inch of material can be cut away from the upper surface of the slab 56, if desired, according to the invention. Indeed, the blades 16 and 22 can be set to cut away three-eighths of an inch, one-half of an inch and even greater quantities of stone material from the upper surface of the slab. Moreover, these greater cutting depths can be performed without any significant increase in the time required for a slab to pass through the machine 10, since the speed of the sawing operation of the invention does not vary significantly with the depth of a cut.

A further advantage of the invention is that the individual saw blades 16 and 22 can easily be replaced, should any of those saw blades become defective. To replace a defective saw blade one of the retaining nuts 21 or 25 is loosened and the exposed saw blades 16 or 22 are withdrawn longitudinally from the axle 18 or 24 until the defective saw blade is exposed. That saw blade is then removed and replaced. The saw blades which have previously been drawn off for the purpose of providing access to the defective saw blade are then packed longitudinally back along the axle 18 into position. The retaining nut 21 or 25 is then replaced and retightened. The machine 10 is then again operational.

Undoubtedly, numerous variations and modifications of the invention will become readily apparent to those familiar with the working, cutting, finished and polishing of stone slabs. Accordingly, the scope of the invention should not be construed as limited to the specific embodiment of the machine depicted or implementation of the method described herein, but rather is defined in the claims appended hereto.

I claim:

1. A machine for reducing the thickness of a stone slab to a desired dimension comprising:

a first set of saw disks all having a common diameter mounted coaxially in mutually parallel planes of alignment on a common axle to define gaps of separation from each other, a second set of saw disks having a common diameter mounted coaxially in mutually parallel planes of alignment which are parallel to said planes of alignment of said saw disks of said first set on a second common axle that is oriented parallel to said first common axle, wherein said saw disks in said second set define gaps of axial separation from each other, and said saw disks in second set are offset in a direction perpendicular to said planes of saw disk alignment from said saw disks of said first set so as to reside in coplanar relationship with said gaps of axial separation between said saw disks of said first set, a flat, supporting bed separated from each of said saw disks by a uniform distance of separation equal to said desired dimension, and means of driving said first and second sets of saw disks in rotation.

2. A machine according to claim 1 further comprising means for propelling a stone slab on said supporting bed in a direction parallel to the planes of alignment of said saw disks.

3. A machine according to claim 1 wherein said flat supporting bed is comprised of an endless conveyor belt disposed horizontally beneath said first and second sets of saw disks.

4. A machine according to claim 1 wherein said saw disks in each set of saw disks are keyed to rotate with the common axle upon which they are mounted, whereby said saw disks in each set of saw disks rotate in tandem with each other.

5. A machine according to claim 4 further comprising annular spacer rings disposed about said axles and between adjacent saw disks thereon.

6. A machine according to claim 1 further comprising means for adjusting said distance of separation between said saw disks and said supporting bed.

7. A machine according to claim 1 wherein said flat supporting bed and said axles are all horizontally disposed and further comprising upright supporting stanchions on opposite sides of said flat supporting bed, a carriage mounted in a horizontal disposition on said stanchions above said flat supporting bed and vertically movable relative thereto, and height adjusting means for moving said carriage in a vertical direction along said stanchions and for adjusting the elevation of said carriage above said supporting bed, and wherein said first and second axles and said means for driving said first and second sets of saw disks in rotation are mounted on said carriage.

8. A machine for reducing the thickness of a stone slab to a uniform, desired dimension comprising:

a first set of saw blades formed as mutually parallel planar disks of a uniform diameter mounted on a first common axle for rotation and defining gaps of separation therebetween, a second set of saw blades formed as mutually parallel planar disks of a uniform diameter mounted for rotation on a second common axle with gaps of separation therebetween and aligned in coplanar relationship with said gaps of separation between said saw blades in said first set wherein said saw blades in said second set are at least as thick as said gaps of separation with which they are aligned, a flat supporting bed parallel to said axles and equidistant from each of said saw blades, whereby the distance between said supporting bed and said saw blades defines said uniform, desired dimension, and means for driving said saw blades in rotation.

9. A machine according to claim 8 further comprising means for forcing a stone slab between said supporting bed and said saw blades in a direction parallel to both said saw blades and said supporting bed.

10. A machine according to claim 9 wherein said flat supporting bed is comprised of an endless conveyor belt having a horizontally disposed upper surface and said means for forcing said stone slab is comprised of a motor driving said conveyor belt.

11. A machine according to claim 10 further comprising a carriage supporting said axles in a horizontal disposition above said upper surface of said conveyor belt and means for varying the elevation of said carriage.

12. A machine according to claim 8 wherein said saw blades are locked to their respective axles and rotate together with their respective axles, and further comprising annular spacer rings disposed on said axles between adjacent saw blades thereon to define said gaps of separation therebetween.

13. A machine according to claim 12 wherein the outer diameters of said annular rings are about one half the diameter of said saw blades between which they are disposed.

14. A method of reducing the thickness of a stone slab using a plurality of mutually parallel saw disks divided into two sets for rotation about separate, parallel axes, wherein the blades in each set are separated from each other by gaps of separation aligned with the disks in each other set, and using a flat supporting bed extending parallel to said axes to define a uniform distance equal to a desired slab thickness between said saw disks and said supporting bed, the steps comprising:

rotating said sets of saw disks about their respective axes, passing a stone slab of initial thickness greater than said uniform distance between said saw disks and said supporting bed in a direction of advancement parallel to both said saw disks and said supporting bed to define channels in said stone slab separated from each other by intervening ridges left by said gaps of separation between said saw disks in said first set, and passing said stone slab in said direction of movement past said saw disks in said second set to remove said intervening ridges therefrom and reduce said slab to a uniform thickness equal to said desired slab thickness.

15. A method according to claim 14 further comprising passing said stone slab between said supporting bed and said first and second sets of blades only a single time to achieve said desired slab thickness.

16. A method according to claim 14 further comprising adjusting the distance of said saw disks from said supporting bed to select said desired slab thickness.

* * * * *